US007444092B2

(12) United States Patent
Naito et al.

(10) Patent No.: US 7,444,092 B2
(45) Date of Patent: Oct. 28, 2008

(54) IMAGE FORMING APPARATUS

(75) Inventors: Norihito Naito, Numazu (JP); Takayuki Namiki, Yokohama (JP); Satoru Inami, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 239 days.

(21) Appl. No.: 11/553,730

(22) Filed: Oct. 27, 2006

(65) Prior Publication Data

US 2008/0095550 A1 Apr. 24, 2008

(30) Foreign Application Priority Data

Oct. 19, 2006 (JP) ..... 2006-284997

(51) Int. Cl.
*G03G 15/02* (2006.01)

(52) U.S. Cl. ..... 399/50; 399/66

(58) Field of Classification Search ..... 399/28, 399/49, 48, 50, 66

See application file for complete search history.

(56) References Cited

U.S. PATENT DOCUMENTS 5,805,951 A 9/1998 Kato et al.
5,835,821 A * 11/1998 Suzuki et al. ..... 399/100
6,163,663 A 12/2000 Shinohara et al.
6,226,469 B1 * 5/2001 Suzuki et al. ..... 399/66
7,003,249 B2 2/2006 Hasegawa et al.
2006/0078356 A1 4/2006 Inami et al.
2006/0083527 A1 * 4/2006 Sakamaki ..... 399/50

FOREIGN PATENT DOCUMENTS

JP 10-207262 8/1998

* cited by examiner

*Primary Examiner*—Hoan H Tran
(74) *Attorney, Agent, or Firm*—Fitzpatrick, Cella, Harper & Scinto

(57) ABSTRACT

An image forming apparatus forming a preferable image without white dots caused by excessive charging when a halftone image is formed by providing a potential difference between a surface potential of a photosensitive drum immediately before charging by a charging device, and that of the drum after the charging in an image forming area of the drum. At least one of a charging bias and a transfer bias is changed between a first area and a second area. The first area is an area on the drum that passes a transfer portion when a recording medium is not present between the roller and the drum, and on that a latent image is to be formed. The second area is an area on the drum that passes the transfer portion when the medium is present between the roller and the drum, and on that a latent image is to be formed.

3 Claims, 10 Drawing Sheets

RECORDING MEDIA
PRINT INSTRUCTION
ROTATION OF PHOTOSENSITIVE DRUM
CHARGING BIAS
VALUE OF SURFACE POTENTIAL OF PHOTOSENSITIVE DRUM
TRANSFER BIAS
POTENTIAL IN SHEET PASSING
POTENTIAL IN NON-SHEET PASSING
ON
OFF
ON
OFF
-1000V
0V
-500V
0V
OFF
FIRST AREA
SECOND AREA
FIRST AREA
SECOND AREA
101
102
103
104
105
106
107
108
109
110
111
112
113
114
115
115

IMAGE FORMING APPARATUS

BACKGROUND OF THE INVENTION

1. Field of the Invention

The present invention relates to an image forming apparatus employing an electrophotographic printing method.

Here, examples of an electrophotographic image forming apparatus include a copying machine, a laser beam printer, an LED printer, and a facsimile apparatus.

2. Description of the Related Art

FIG. 2 is a schematic diagram of a conventional image forming apparatus employing an electrophotographic printing method.

In the image forming apparatus employing the electrophotographic printing method such as a copying machine and a laser beam printer, a photosensitive drum 201, which is an electrostatic latent image bearing member, is uniformly charged and is irradiated with a laser beam 203 which corresponds to image information, to thereby form an electrostatic latent image. In the image forming apparatus, the electrostatic latent image is exposed by supplying the electrostatic latent image with a developer (hereinafter, referred to as "toner") as a recording material, by using developing means 204, and then the image is transferred onto a recording medium 210 from the photosensitive drum, to thereby form an image on the recording medium.

The image forming apparatus includes a charging device 202 for uniformly charging the photosensitive drum 201 and an exposure device 203 for forming the electrostatic latent image corresponding to printing information and image information through laser exposure onto the charged photosensitive drum 201, used for reproducing the image information on the photosensitive drum 201. The image forming apparatus further includes a developing roller 204 for visualizing the formed electrostatic latent image with a developer (i.e., toner).

In addition, the image forming apparatus includes a transfer device 205 for transferring a toner image reproduced on the photosensitive drum 201 onto the recording medium 210, a cleaning device 206 for removing transfer residual toner on the photosensitive drum 201, and a fixing device 207 for permanently fixing the toner image transferred on the recording medium.

Image forming processes of the conventional image forming apparatus are carried out at a timing shown in FIG. 3.

In FIG. 3, the same areas on the photosensitive drums are represented by vertical lines. FIG. 3 shows a timing of a print instruction, a timing of a rotation of the photosensitive drum, and a relationship among charging bias (i.e., voltage applied to a charging member) of a corresponding area, a surface potential of the photosensitive drum, and a transfer bias (i.e., voltage applied to the transfer member) which are measured immediately after the charging.

Each interval between scale lines indicated by the broken lines parallel to an ordinate axis represents half the circumference of the photosensitive drum. An abscissa axis represents a length of elapsed time.

First, an image forming apparatus main body receives a print instruction from an external computer or the like (301), and then the photosensitive drum starts rotating (302).

After that, a charging bias of −1000 V is applied to the charging device (303) to uniformly charge a surface of the photosensitive drum to a charged potential VD of −500 V (304).

In this case, a predetermined constant charging bias is applied to a charging roller regardless of whether it is before an image forming process, during the image informing process, or during an interval between image forming processes.

After that, an electrostatic latent image is formed on the photosensitive drum having been charged to the charged potential VD, and the surface potential of an exposed portion on the photosensitive drum becomes an exposure potential VL (FIG. 3 shows a case where image exposure is not carried out, for convenience).

When the electrostatic latent image formed on the photosensitive drum reaches the developing roller, the electrostatic latent image is subjected to development to be visualized on the photosensitive drum as a toner image.

When the toner image visualized on the photosensitive drum reaches the transfer roller, the toner image is applied with a predetermined transfer bias (305), thereby being electrostatically transferred onto a recording medium supplied from a cassette serving as a feeding apparatus in synchronization with the print instruction.

Then, the recording medium having the toner image transferred thereon is transported to the fixing device, and the toner image is applied with heat and pressure, thereby being fixed on the recording medium as a permanent image.

When transfer residual toner on the photosensitive drum having passed through the transfer roller reaches the cleaning device, the transfer residual toner is removed by the cleaning device from the surface of the photosensitive drum. Then, the surface of the photosensitive drum is charged again by the charging roller to be readied for the subsequent image formation.

Examples of the above-mentioned image forming apparatus include one in which, as a control of the transfer bias, the transfer bias is applied to a non-image forming area, which is generated during an interval between the recording media (306) or at a time of an initial rotation before printing (307), to perform correction of the transfer bias (see Japanese Patent Application Laid-Open No. H10-207262). In the image forming apparatus, the transfer bias is applied to the non-image forming area, and a transfer current or a transfer voltage obtained at that time is monitored, to thereby detect a change in resistance of the transfer roller serving as a transfer member, based on the current value and the voltage value. According to the detected change in resistance of the transfer roller, the transfer bias at the time of transfer of the toner image is corrected.

However, in the image forming apparatus in which the transfer member, of which a surface is composed of a foam, is directly abutted against the image bearing member, and in which voltage is applied to the transfer member even when the recording material is not present in a transfer portion, there arises a problem of excessive charging in which a part of the potential of the charged image bearing member becomes a predetermined potential or more.

Even when the recording material is not present in the transfer portion as shown in the above-mentioned conventional example, in a case where voltage is continuously applied to the transfer member, the potential of the image bearing member having passed through the transfer portion is generally lowered by elimination of charge under the influence of voltage. In the transfer portion, the problem of the excessive charging is not raised when the potential of the image bearing member is uniformly reduced by elimination of charge.

However, when the surface of the transfer member is composed of a foam, a difference in amount of a current flowing from the transfer member to the image bearing member is generated between a void portion (i.e., cell portion) and a non-void portion (i.e., non-cell portion) of the transfer roller.

When the image bearing member passes through the transfer portion, in an area on the image bearing member which corresponds to the non-cell portion of the transfer member, a current can easily flow from the transfer member to the image bearing member, and the potential of the image bearing member is affected by the transfer bias, thereby reducing the potential of the image bearing member by elimination of charge. On the other hand, when the image bearing member passes through the transfer portion, in an area on the image bearing member which corresponds to the cell portion of the transfer member, a current cannot easily flow as compared with the case where the area corresponds to the non-cell portion. As a result, the potential of the image bearing member is hardly affected by the transfer bias, so the potential is not changed in the transfer portion.

The potential of the area on the image bearing member which corresponds to the cell portion is not changed in the transfer portion. For this reason, the area reaches the charging portion again while maintaining the potential obtained through the previous charging by the charging member, thereby being charged to the same potential by the charging member. Thus, in a case where almost no potential difference is generated between potentials before and after the charging by the charging member, a phenomenon called excessive charging is caused in which the charge on the area is increased to the desired potential or more. The area in which the excessive charging has been caused has a desired potential or more, so there may arise a problem in that white dots appear at the time of image formation (particularly at the time of formation of a halftone image).

SUMMARY OF THE INVENTION

It is an object of the present invention to provide an image forming apparatus in which a transfer member, of which a surface is composed of a foam, is directly abutted against an image bearing member, and voltage is applied to the transfer member even when a recording material is not present in a transfer portion in order to suppress generation of excessive charging and suppress generation of white dots generated due to the excessive charging at the time of image formation.

Further features of the present invention will become apparent from the following description of exemplary embodiments with reference to the attached drawings.

DESCRIPTION OF THE EMBODIMENTS

Hereinafter, preferable embodiments of the present invention will be illustratively described in detail with reference to the drawings.

In this case, measurements, materials, and shapes of components described in the embodiments, and positional relationship among the components may be appropriately modified according to the structure of an apparatus to which the present invention is applied and various conditions in which the apparatus is operated. Further, the following embodiments of the present invention are not intended to limit the scope of the present invention.

First Embodiment

A first embodiment of the present invention will be described with reference to the attached drawings.

According to the first embodiment, an image forming area represents an area on a surface of a photosensitive drum which passes through a transfer portion when a recording medium serving as a recording material is present in a transfer portion. A non-image forming area represents an area other than the image forming area.

In addition, a time of image formation represents a time when process means such as charging, exposure, development, and transfer are operated on the image forming area. Accordingly, to be exact, the time of image formation in association with charging is different from the time of image formation in association with transferring. A time of non-image formation represents a time other than the time of image formation.

Figure 1:
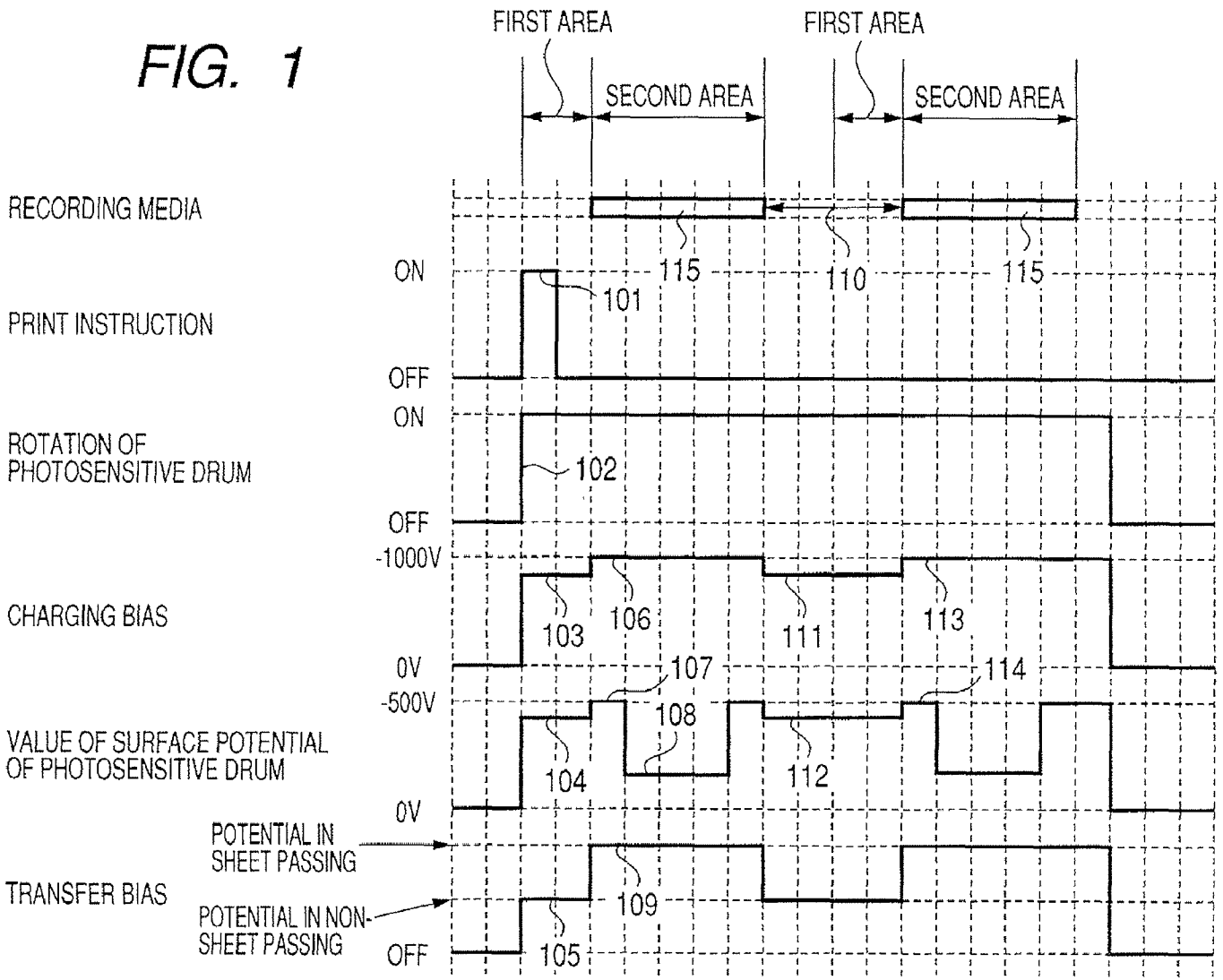
FIG. 1 is a schematic explanatory diagram of a sequence chart according to a first embodiment of the present invention.
Figure 2:
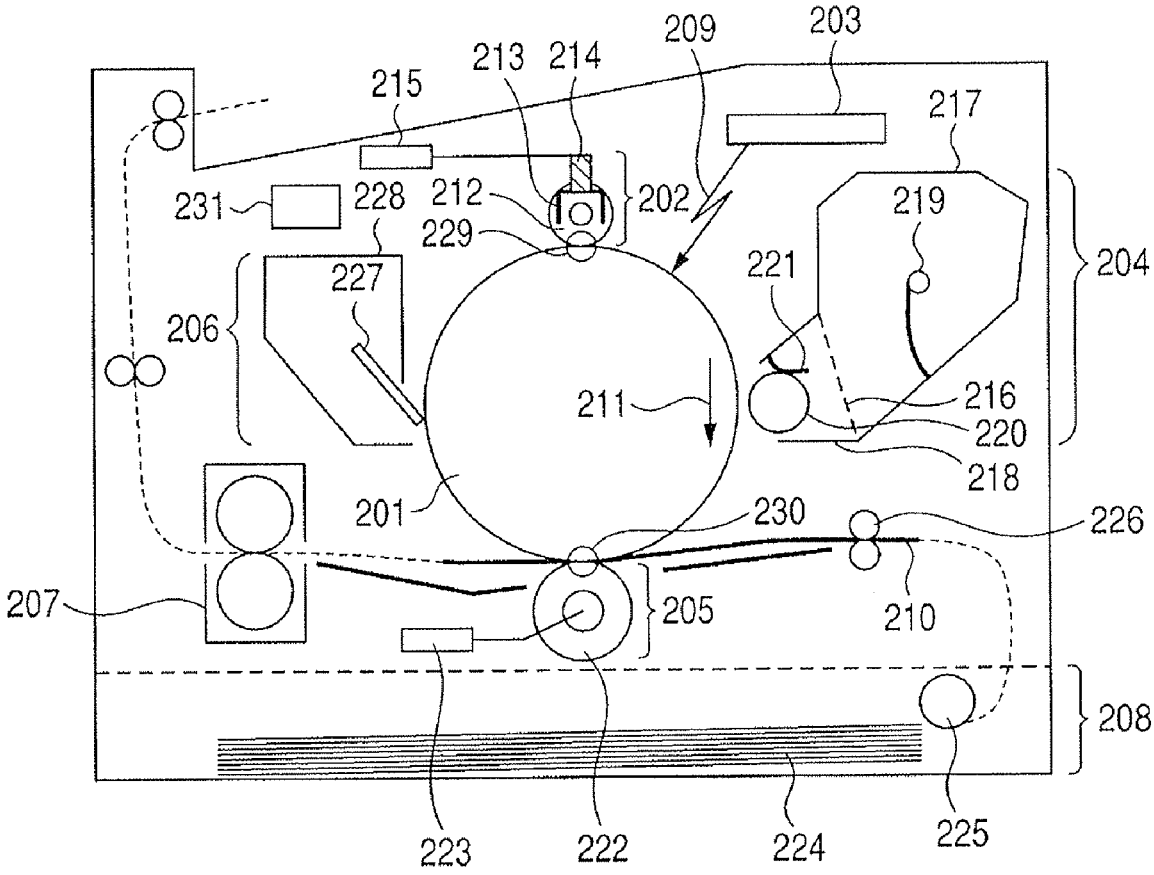
FIG. 2 is a schematic explanatory diagram of an image forming apparatus according to the first embodiment of the present invention.
Figure 3:
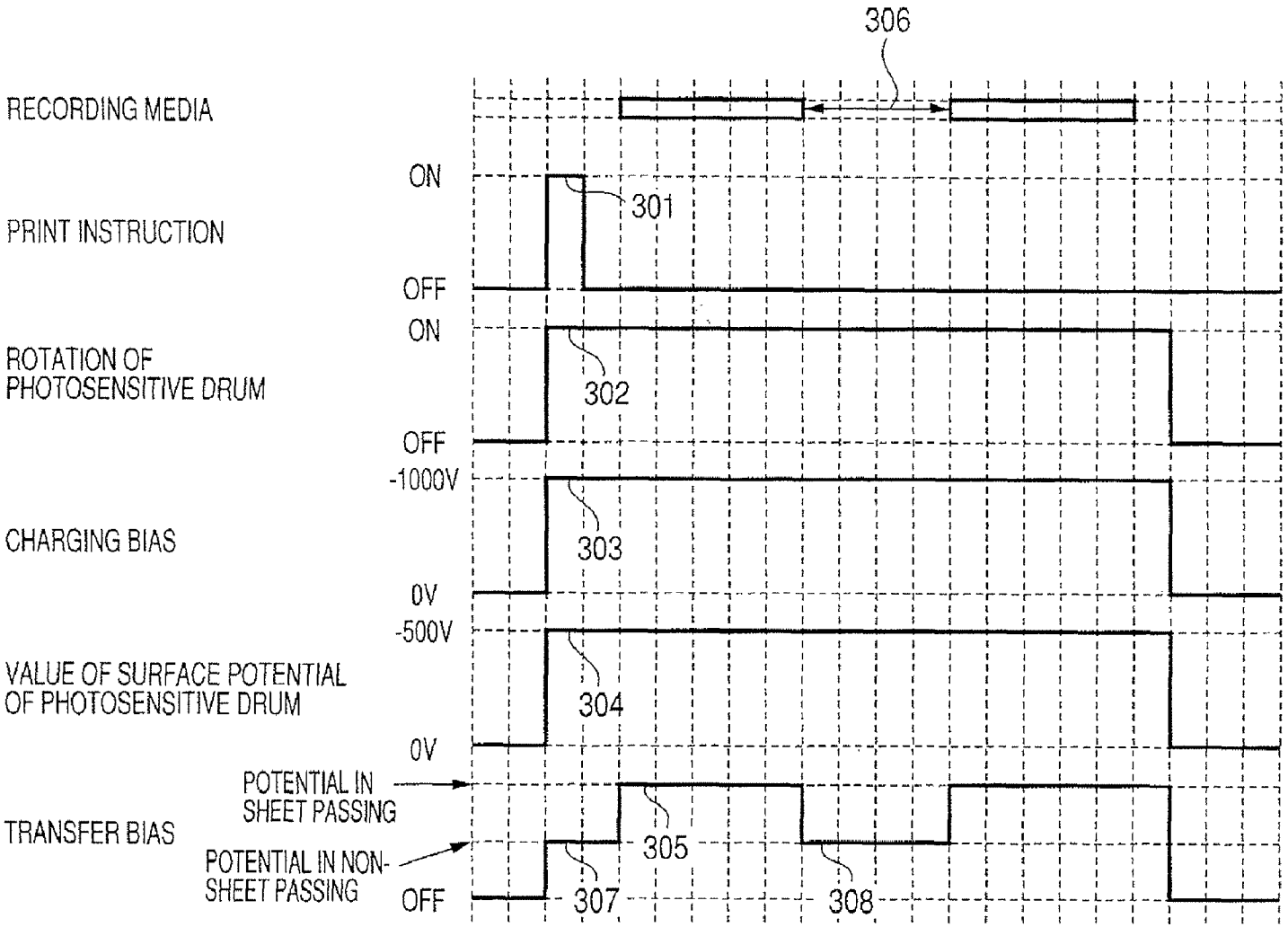
FIG. 3 is a schematic explanatory diagram of a conventional sequence chart according to the first embodiment of the present invention.

FIG. 2 is a schematic diagram of an image forming apparatus according to the first embodiment. A structure of the image forming apparatus is basically the same as that of the conventional art, so FIG. 1 is used for explanation thereof.

In the image forming apparatus, a photosensitive drum 201 serving as an image bearing member on which an electrostatic latent image is formed at the middle part thereof is arranged.

On the periphery of the photosensitive drum 201, there are provided the following parts: a charging device 202 for uniformly discharging and charging the photosensitive drum 201; an exposure device 203 for forming an electrostatic latent image corresponding to printing information and image information by a laser exposure 209 onto the charged photosensitive drum 201; a developing device 204 for visualizing the formed electrostatic latent image using a developer (i.e., toner); a transfer device 205 for transferring the visualized toner image onto a recording medium 210 which is a recording material; a cleaning device 206 for removing transfer residual toner and the like on the photosensitive drum 201; a fixing device 207 for permanently fixing the toner image transferred on the recording medium 210; and a cassette 208 serving as a sheet feeding apparatus for supplying the recording medium.

The above-mentioned parts will be described in further detail.

The photosensitive drum 201 has a three-layered structure in which an undercoat layer having a thickness of about 1 μm, a change generation layer (CGL) having a thickness of several μm, and a charge transport layer (CTL) having a thickness of about 15 μm are formed on an aluminum cylinder of a diameter of 24 mm by being subsequently coated and laminated by a dipping process or the like. In addition, the photosensitive drum 201 is rotationally driven by the driving means in a direction 211 indicated by the arrow at a predetermined circumferential speed. In the first embodiment, the photosensitive drum 201 rotates at a circumferential speed of 113.1 mm/sec, that is, 1.5 revolutions per second.

The charging device 202 is mainly constituted of a charging roller 212 serving as a charging member, a conductive supporting member 213, a spring member 214, and a charging bias power supply 215. The charging roller 212 is constituted of a conductive elastic layer composed of urethane rubber having a thickness of about 3 mm formed on a cored bar of a diameter of 6 mm, and a high-resistance layer in which carbon black is dispersed in urethane rubber having a thickness of several μm formed on the conductive elastic layer. The supporting member 213 rotationally supports the charging roller 212 from both ends thereof. The spring member 214 presses, together with the supporting member 213, the charging roller 212 against the photosensitive drum 201 so that the charging roller 212 is abutted against the photosensitive drum 201 with an appropriate pressing force. The charging bias power supply 215 applies voltage to the charging roller 212 through the spring member 214 and the supporting member 213.

The charging roller 212 is arranged to be brought into contact with the photosensitive drum 201 in a charging portion 229 and be driven to rotate with a rotation of the photosensitive drum 201. The charging roller 212 is applied with a charging bias, which is larger than a discharge starting voltage, by the charging bias power supply 215, and discharges between the photosensitive drum 201 and the charging roller 201 to charge the photosensitive drum 201. The discharge starting voltage represents a potential difference at which the discharge is started between the charging roller 212 and the photosensitive drum 201. When voltage is applied to the charging roller 212, the surface potential of the photosensitive drum 201 becomes a potential obtained by subtracting the discharge starting voltage from voltage applied to the charging roller 212. The discharge starting voltage in the structure according to the first embodiment is set to 500 V. The charging roller 212 is applied with a DC voltage of about −1000 V to charge the surface potential of the photosensitive drum 201 at −500 V. Here, adopted is a contact charging system in which charging is performed by the application of the DC voltage without an AC voltage component to the charging roller 212, which is a so-called DC charging system. The DC charging system is more advantageous in terms of lower amount of ozone production and lower cost of apparatus as compared with an AC charging system in which the AC voltage is stacked on the DC voltage on the charging roller. Another advantage of the DC charging system is that the amount of a current required for the discharge for charging the surface of the photosensitive drum 201 to the predetermined potential is smaller, so a scraped quantity on the surface of the photosensitive drum 201 is smaller.

The exposure means 203 employs a laser beam scanner in the first embodiment. The scanner includes a semiconductor laser, a polygon mirror, and an F-θ lens. The scanner emits the laser beam 209 controlled to be turned on or off according to the image information transmitted from a host apparatus (not shown) to scan and expose the uniformly charged surface of the photosensitive drum 201, thereby forming an electrostatic latent image. In the first embodiment, employed is the exposure means 203 in which the amount of laser beam is adjusted so that the surface potential (i.e., exposure potential) of the exposed area of the surface of the photosensitive drum 201 becomes −150 V.

The developing member 204 is partitioned by a partition part 216 into a toner container 217 for storing toner and a developer container 218. An agitating device 219 is arranged in the toner container 217 and feeds toner in the developer container 218. In the developer container 218, a developing roller 220 for developing an electrostatic latent image formed on the photosensitive drum 201, and a regulating blade 221 for regulating a thickness of a toner layer of the developing roller 220. As a development, a jumping development, a dual-component development, or the like is employed. In the first embodiment, a combination of an image exposure and a reversal-development is employed. The electrostatic latent image is reversal-developed with toner to form a toner image as a developer image.

The transfer device 205 includes a transfer roller 222 serving as a transfer member, of which a surface layer is composed of a foam made of a sponge of an electronic conductive system of a diameter of 16 mm, or a sponge of an ionic conductive system, and a transfer bias power supply 223 for applying voltage to the transfer roller 222. The transfer roller 222 is brought into contact with the photosensitive drum 201 in a transfer portion 230, and the toner image formed on the photosensitive drum 201 is transferred onto the recording medium when the recording medium passes between the transfer roller 222 and the photosensitive drum 201. Since the reversal-development is employed in the first embodiment, a positive transfer bias opposite to that of the polarity charged by the charging roller on the photosensitive drum 201 is applied to the transfer roller. In the first embodiment, the transfer bias is applied to the transfer roller even when the recording medium is not present in the transfer portion, thereby performing a resistance detection control (e.g., ATVC or PTVC) for detecting a resistance of the transfer roller 222. The resistance detection control is performed prior to the image formation, and it is possible to apply the stable and appropriate transfer bias independently of a set environment of the image forming apparatus or a change in resistance of the transfer roller, at the time of image formation. The resistance detection control is performed during an initial rotation (i.e., preparation period for image formation) before the image formation, and an interval between the recording media (i.e., period between a time when a trailing edge of the former recording medium passes the transfer portion and a time when a leading edge of the subsequent recording medium reaches the transfer portion) in a consecutive printing. Thus, in the first embodiment, the transfer bias is applied to both the image forming area and the non-image forming area. As a result, overshoot of the transfer bias is not caused in the structure in which the transfer bias is also applied to the non-image forming area, so such the structure is preferable to a structure in which the transfer bias is turned off on the non-image forming area. The overshoot of the transfer bias indicates that, when the transfer bias turned off on the non-image forming area is turned on to correspond to the image forming area, the transfer bias larger than the desired transfer bias is applied to the transfer roller. When the transfer bias larger than the desired transfer bias is applied to the transfer roller, the overshooting may cause an adverse effect on an image.

As a control method for the transfer bias power supply, there are a constant current control method capable of energizing with a predetermined current value, and a constant voltage control method of applying a predetermined voltage value. In the constant current control method, the current value flowing from the transfer roller to the photosensitive drum becomes the same on the non-image forming area and the image forming area. In the first embodiment, the constant current control method is employed, and a resistance of the transfer portion becomes lower because the recording medium is not present in the transfer portion with respect to the non-image forming area, thereby obtaining the transfer voltage value of the non-image forming area which is lower as compared with that on the image forming area. The structure in which voltage is applied to the transfer roller 222 both on the image forming area and the non-image forming area is preferably used because, in a case where the constant current control is performed, the stable current value can be supplied independently of presence or absence of toner on the photosensitive drum and types of recording materials, to thereby stabilize the transfer performance.

Recording media 224 which are recording materials contained in the cassette 208 serving as a feeding apparatus are supplied to a registration roller 226 by a sheet feed roller 225 in synchronization with formation of a visualized image on the photosensitive drum 201.

Then, the recording media 224 are transported between the transfer roller 222 and the photosensitive drum 201 in synchronization with the leading edge of the visualized image formed on the photosensitive drum 201 by the registration roller 226.

The toner image formed on the photosensitive drum 201 is transferred onto the recording medium 210 by the application of the transfer bias to the transfer roller 222.

The toner image transferred on the recording medium 210 is transported to the fixing device 207 together with the recording medium 210, and is fixed on the recording medium 210 by being applied with heat and pressure, thereby forming a recorded image.

On the other hand, the transfer residual toner on the photosensitive drum 201 remained after a passage through the transfer device 205 is removed from the surface of the photosensitive drum 201 by the cleaning device 206 including a cleaning blade 227, and the removed toner is stored in a waste toner container 228.

After that, the surface of the photosensitive drum 201 is charged again by the charging device 202 to be readied for the subsequent image formation.

A CPU 231 serving as a control device controls the charging bias power supply 215, the developing bias power supply, and the transfer bias power supply 223, to thereby control voltages applied to the charging roller 212, the developing roller 220, the transfer roller 222, respectively.

In addition, in the structure of the image forming apparatus according to the first embodiment, the circumferential speed of the photosensitive drum is set to 113.1 mm/sec as described above. As a printing speed, each interval between the recording media is set to continuously perform printing on about 15 sheets of recording materials of A4-size per minute. In the first embodiment, the interval between the recording media is set to about 166 mm which is about twice as long as the circumference of the photosensitive drum. In this case, as means for setting the interval between the recording media, adopted is regulation of the sheet feed timing for the recording media.

Next, a description will be given as to generation of image defects caused by the excessive charging in the image forming apparatus including a transfer roller, of which a surface is composed of a foam. The charging roller also charges the non-image forming area on the surface of the photosensitive drum in order to prevent toner from being unnecessarily scattered over the surface of the photosensitive drum by the developing device. Further, the transfer bias is applied also to the non-image forming area, which is generated at the time of the initial rotation or at the interval between the recording media in consecutive sheet passing, to measure the resistance of the transfer roller.

It becomes evident that, in a case of forming a halftone image in the above-mentioned structure, an infinite number of white dots are generated in an image area which corresponds a length of the circumference of the photosensitive drum from the leading edge of the recording medium. This is because the transfer roller, of which the surface is made of a sponge, is charged with the transfer bias on the non-image forming area in which the recording medium is not present in the transfer portion.

When the transfer bias is applied to the non-image forming area, a difference in amount of a current flowing from the transfer roller 222 to the photosensitive drum 201 is generated in the void portion (i.e., cell portion) and the non-void portion (i.e., non-cell portion) of the transfer roller 222.

When the photosensitive drum 201 passes through the transfer portion, in the area on the surface of the photosensitive drum 201 which corresponds to the non-cell portion of the transfer roller 222, a current can easily flow from the transfer roller 222 to the photosensitive drum 201, so the potential of the photosensitive drum 201 is reduced by elimination of charge under the influence of the transfer bias. On the other hand, when the photosensitive drum 201 passes through the transfer portion, in the area on the surface of the photosensitive drum 201 which corresponds to the cell portion of the transfer roller 222, a current cannot easily flow from the transfer roller 222 to the photosensitive drum 201 as compared with the case of the area corresponding to the non-cell portion. Accordingly, the potential of the photosensitive drum 201 is hardly affected by the transfer bias, and the potential is not changed in the transfer portion.

In the area on the surface of the photosensitive drum 201 which corresponds to the cell portion of the transfer roller 222, the potential is not changed in the transfer portion. As a result, the area reaches the charging portion while maintaining the potential obtained through the charging by the charging roller 212, and is charged to the same potential by the charging roller 212. Thus, in the case where almost no potential difference is generated between potentials before and after the charging by the charging roller 212, a phenomenon called excessive charging is caused in which charge on the area is increased to the desired potential or more. For example, in a case where the photosensitive drum is charged by the application of voltage of −1000 V to the charging roller 212 when the discharge starting voltage is set to 500 V, the photosensitive drum is charged at a potential of −500 V. However, in a case where the photosensitive drum is to be charged by the application of voltage of −1000 V to the charging roller in a state where the potential of the photosensitive drum already is −500 V, the potential of the photosensitive drum 201 is supported to be −500 V in theory, but in fact, the potential of the photosensitive drum 201 becomes larger than −500 V.

Thus, the potential of the area in which the excessive charging is caused becomes larger than the desired potential, so the potential is not sufficiently lowered to the exposure potential even after the exposure, which may generate white dots at the time of image formation. The excessive charging is caused in the cell portion of the transfer roller 222, so the white dots on the image are also generated to correspond to the shapes of the cell portions of the transfer roller.

It becomes evident that the white dots due to the excessive charging are caused in a case where voltage applied to the charging roller 402 or voltage applied to the transfer roller 222 has not changed on the image forming area or the non-image forming area in the image forming apparatus employing the transfer roller, of which a surface layer is composed of a foam.

The mechanism of the generation of the excessive charging was examined.

First, a charging characteristic of the charging roller for charging the surface of the photosensitive drum is observed by conducting the following experiment.

Figure 4:
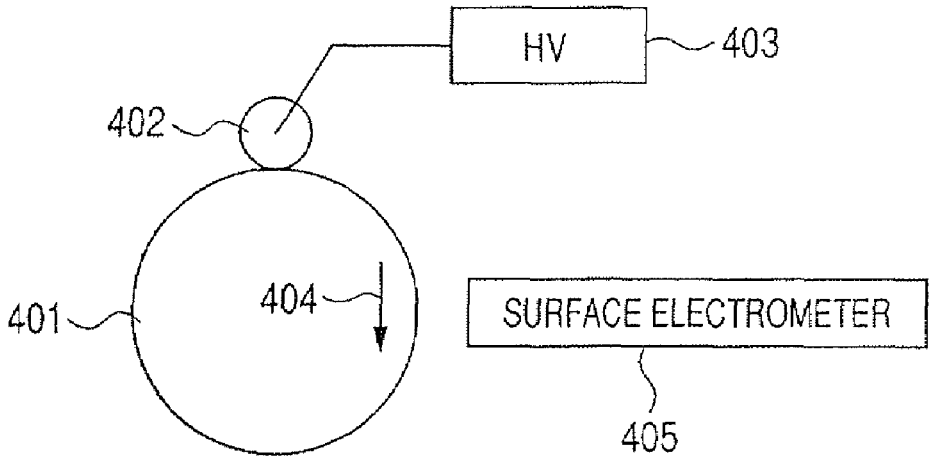
FIG. 4 is a schematic explanatory diagram of an experimental apparatus according to the first embodiment of the present invention.

The experiment was conducted by preparing an experimental apparatus shown in FIG. 4.

As shown in FIG. 4, a photosensitive drum 401, the charging roller 402, and high-voltage applying means 403 are prepared, and the photosensitive drum 401 is rotated and operated in a direction 404 indicated by the arrow shown in FIG. 4. In a position at a downstream of the rotational direction at an angle of 45° from the charging position of the charging roller 402, a surface electrometer 405 used to measure a surface potential of the photosensitive drum is arranged. The surface electrometer used in the first embodiment was Model 344 manufactured by TREK, Co.

As an experimental method, a constant applied voltage is outputted from the high-voltage applying means to the charging roller to charge the surface of the photosensitive drum to the constant charged potential (surface potential in this case is set as a potential I).

When the charged potential of the photosensitive drum is measured by the surface electrometer, and is confirmed to be stabilized at the potential I, the applied voltage of the high-voltage applying means is changed instantaneously, and the charged potential of the area after the applied voltage is instantaneously changed is measured using the surface electrometer (surface potential measured after the applied voltage is changed is set as a potential II). In order to set a target potential obtained as the potential II to −500 V, voltage of −1000 V was applied to the charging roller. The potential I at which the charged voltage was stabilized was set in a range from 0 V to 500 V to confirm a relationship between the potential I and the potential II.

Figure 5:
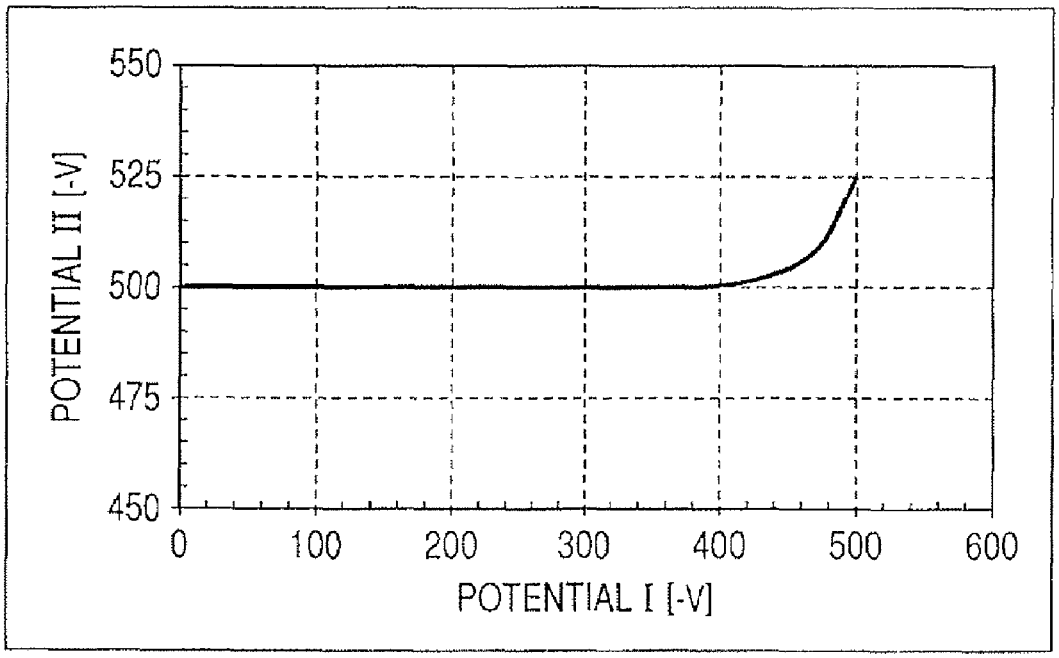
FIG. 5 is a schematic explanatory diagram of a residual potential and a charged potential of a photosensitive drum according to the first embodiment of the present invention.

The result is as shown in FIG. 5. It is apparent from FIG. 5 that the target potential can be stably obtained at the potential II when the potential I is set in about a range from 0 V to −400 V. However, it becomes evident that when the potential I is set in a range from −400 V to −450 V, the potential II becomes gradually apart from the target potential, and when the potential I is set in about a range from −450 V to −500 V, the phenomenon of the excessive charging in which the charged potential becomes larger than the target potential is remarkably caused.

It is apparent from the experimental result that, when there is no potential difference between the potential I and the potential II, the excessive charging is caused. It is also apparent that even when the same experiments are conducted by changing the target potential of the potential II, the excessive charging is easily caused in a case where there is no potential difference between the potential I and the potential II as in this experiment. Further, it is apparent that the excessive charging is less likely to be caused when the potential difference between the potential I and the potential II becomes larger, particularly when the potential difference becomes 100 V or more, almost no excessive charging is caused.

Next, the phenomenon actually caused in the image forming apparatus was confirmed.

Figure 6:
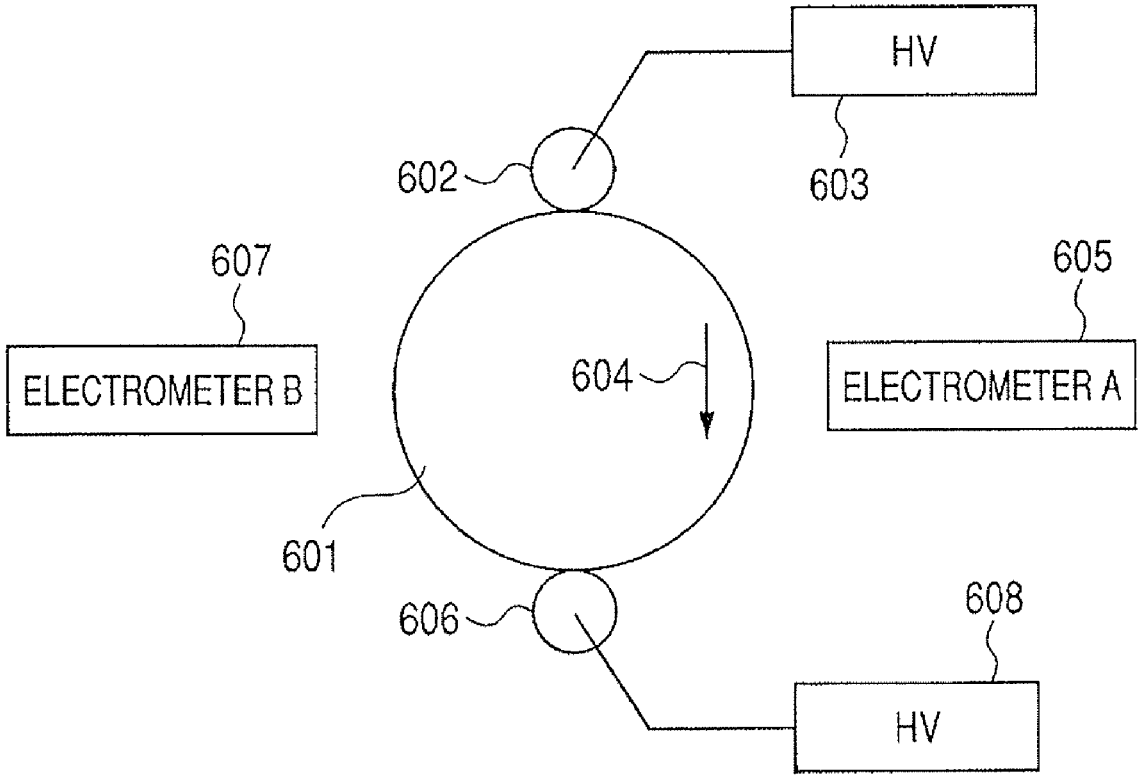
FIG. 6 is a schematic explanatory diagram of the experimental apparatus according to the first embodiment of the present invention.

The confirmation was performed by an experimental method shown in FIG. 6.

As shown in FIG. 6, the experiment is conducted by arranging a photosensitive drum 601, a charging roller 602, high-voltage applying means 603, a rotational direction 604, and a surface electrometer 605 in the same manner as in the above-mentioned experimental apparatus. In addition to those, a transfer roller 606 is arranged at a downstream of the rotational direction of the photosensitive drum 601 at an angle of 180° with respect to the charging roller 602, and the transfer roller 606 is connected to high-voltage applying means 608 in the same manner as the charging roller 602 connected to high-voltage applying means 603. In a position at a downstream of the rotational direction of the photosensitive drum 601 at an angle of 45° from the transfer roller 606, another surface electrometer 607 is arranged. A position at the downstream of the charging roller 602 at an angle of 45° is set as a point A, and the electrometer 605 used to measure a surface potential of the point A is represented as an electrometer A. A position at the downstream of the transfer roller 606 at an angle of 45° is set as a point B, and the electrometer 607 used to measure a surface potential of the point B is represented as an electrometer B. In other words, the electrometer A indicates a potential of the photosensitive drum immediately after the charging by the charging roller, and the electrometer B indicates a potential of the photosensitive drum after being affected by the transfer bias by the transfer roller. Here, the applied voltage to the charging roller by a high-voltage power supply was controlled with a constant voltage of −1000 V so that the charged potential of the point A was set to be −500 V. The applied voltage to the transfer roller was controlled by constant current control such that energization was performed with a current of 3 μA at which a preferable transfer image was able to be obtained, at a rotational speed of the photosensitive drum of 113 mm/sec in the first embodiment.

Figure 7A:
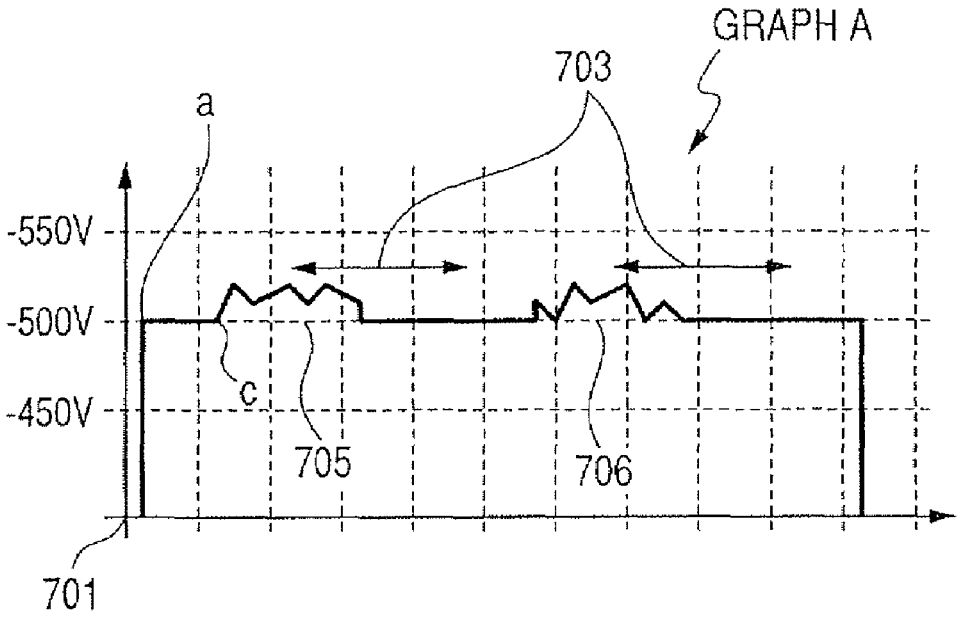
FIGS. 7A and 7B are schematic explanatory diagrams each showing an potential of the photosensitive drum according to the first embodiment of the present invention.
Figure 7B:
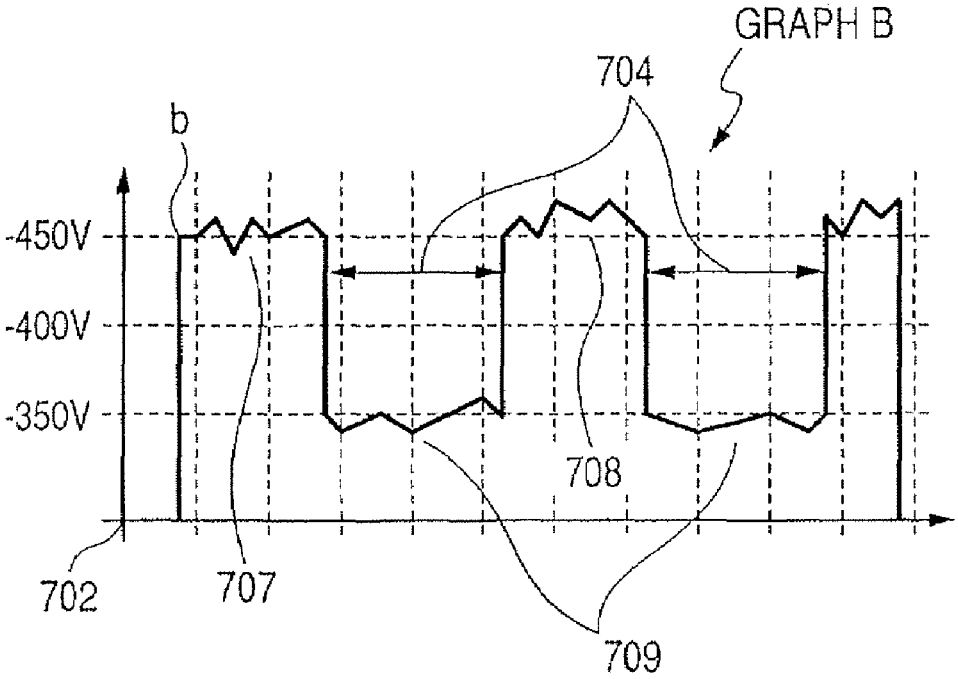

The potential measured using the electrometer A is represented in a graph A of FIG. 7A, and the potential measured using the electrometer B is represented in a graph B of FIG. 7B. In FIGS. 7A and 7B, intersection points 701 and 702 of the vertical and horizontal numeral axes represent drive start points of the photosensitive drum. An interval indicated by the broken lines represents a time period corresponding to one rotation of the photosensitive drum. The electrometer B is positioned on the downstream side of the position of the electrometer A at a distance corresponding to a half circumference of the photosensitive drum. Accordingly, the area on the photosensitive drum which has been measured using the electrometer A is measured using the electrometer B again after a lapse of time for the half rotation of the photosensitive drum. A point a shown in the graph A of FIG. 7A, a point b shown in the graph B of FIG. 7B, and a point c shown in the graph A of FIG. 7A represent the same point on the photosensitive drum. Thus, the point a shown in the graph A of FIG. 7A after the photosensitive drum is half-rotated is represented as the point b shown in the graph B of FIG. 7B, and the point a after the photosensitive drum is further half-rotated is represented as the point c shown in the graph A of FIG. A.

In the graph A of FIG. 7A, arrows 703 indicate ranges of areas (i.e., image forming areas) on the photosensitive drum which are to pass through the transfer portion when the recording medium is present in the transfer portion. The surface potential of the photosensitive drum measured using the electrometer A was substantially stabilized at −500 V over the printing operation. In areas (705 and 706) which correspond to a length of the circumference of the photosensitive drum from the leading edge of the recording medium, the potentials are fluctuated, and the white dots due to the excessive charging are generated in images formed on the corresponding areas.

In the graph B of FIG. 7B, arrows 704 indicate ranges of areas (i.e., image forming areas) on the photosensitive drum which have been passed through the transfer portion when the recording medium is present in the transfer portion. The surface potential of the photosensitive drum measured using the electrometer B is distributed into two ranges, that is, a range in which the surface potential is −450 V and a range in which the surface potential is −350 V depending on the printing operation. When the recording medium is present in the transfer portion, the potential of each area 704 having passed through the transfer portion after the transfer becomes −350 V (709), which is lower than the potential of −450 V (707, 708) of the area having passed through the transfer portion after the transfer when the recording medium is not present in the transfer portion. This is because more charge of the photosensitive drum is moved to the recording medium when the recording medium is present in the transfer portion, so the potential of the photosensitive drum is easily lowered. Further, it becomes evident that the areas (707, 708) in which the potential after the transfer is −450 V correspond to areas (i.e., non-image forming areas) in which the photosensitive drum is directly brought into contact with the transfer roller without nipping the recording medium in the transfer portion, and also correspond to areas shown in the graph A in which the charged potential is unstable.

Figure 8A:
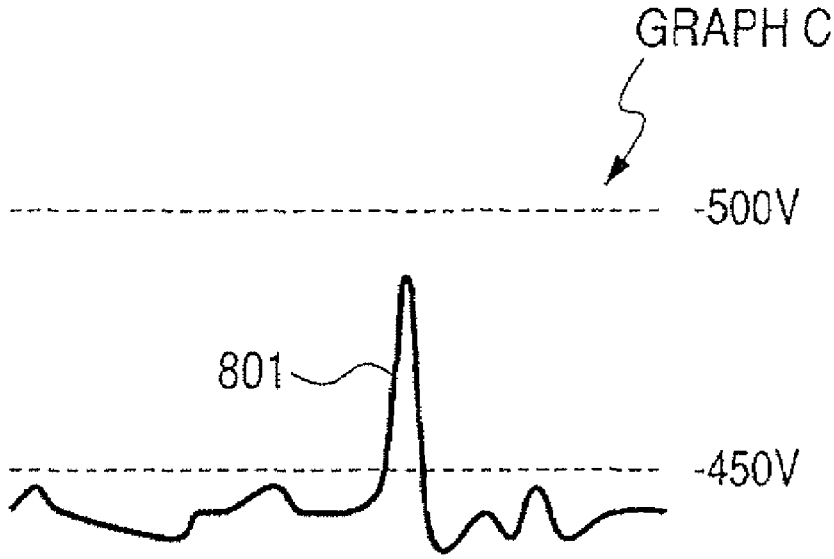
FIGS. 8A and 8B are schematic explanatory diagrams each showing white dots due to excessive charging according to the first embodiment of the present invention.
Figure 8B:
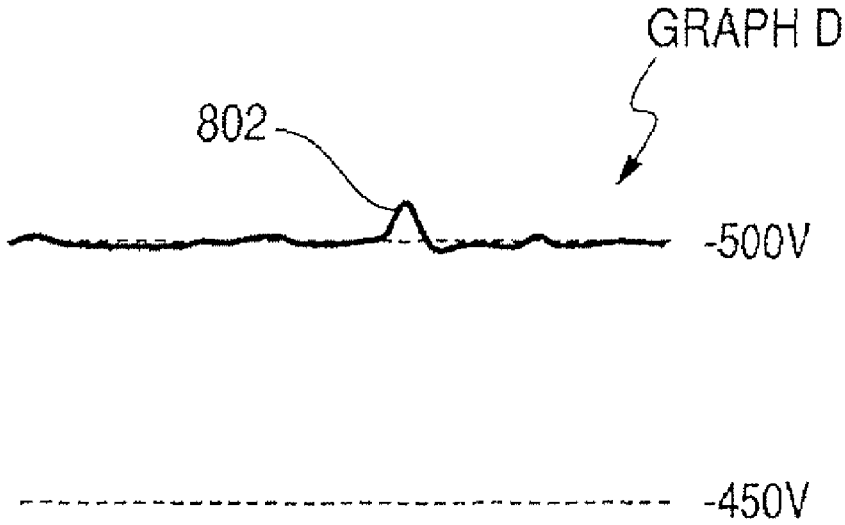

In the area shown in graph B in which the charged potential was unstable, fluctuation of only about several V around −450 V was detected. However, it is assumed that the surface electrometer used in this experiment detects a time average value of the surface potential in view of its non-contact detection, responsibility, and resolution. As a result, it is assumed that when the surface potential is microscopically observed, the area in which the charged potential is unstable includes an area in which the potential is not fluctuated several V around −450 V but is largely fluctuated from the average value of the potential of −450 V, which will be described with reference to FIGS. 8A and 8B. A graph C of FIG. 8A is a schematic diagram showing a surface potential of the area on the photosensitive drum which corresponds to the non-image forming area after being applied with the transfer bias. A graph D of FIG. 8B is a schematic diagram showing a surface potential of the area on the photosensitive drum which corresponds to the non-image forming area after being applied with the charging bias. The graph C of FIG. 8A shows that the non-image forming area is charged to the surface potential of about −450 V on average. However, as shown in the graph C of FIG. 8A, it is assumed that a peak value 801 approximate to −500 V which is the previous charged potential obtained by the charging roller is locally present. Thus, the area in which the surface potential becomes a potential approximate to the charged potential is assumed to be an area corresponding to the cell portion of the transfer roller in the transfer portion. In the area corresponding to the cell portion of the transfer roller, a current of the transfer bias cannot easily flow, so the potential obtained by the previous charging by the charging roller is hardly changed.

Thus, when the charging is performed to obtain the potential of −500 V again by the charging roller in a state where the peak value 801 is locally present, an excessive charged state 802 of the charged voltage in which the potential exceeds the target potential of −500 V is caused as shown in the graph D of FIG. 8B. As shown in FIG. 5, the larger the potential difference between potentials before and after the charging becomes, the more the generation of the excessive charging can be suppressed.

It is assumed that the reason that the white dots due to the excessive charging are not generated after the photosensitive drum has been rotated once from the leading edge of the recording medium is as follows. As shown in the graph B of FIG. 7B, when the recording medium is present in the transfer portion, the surface potential of the point B is extremely low (709). Thus, since a sufficient potential difference is obtained with respect to the target charged potential of −500 V by the charging roller, it is assumed that white dots are not generated on the image forming area. Further, when the recording medium is present in the transfer portion, an electric current is applied from the transfer roller to the photosensitive drum uniformly through the recording medium. As a result, it is assumed that the partial excessive charging due to a difference in amount between the current passing through the cell portion and the current passing through the non-cell portion does not occur.

According to the first embodiment, it is an object to prevent the white dots from being generated in images even when an uneven potential due to the difference in amount between the current passing through the cell portion and the current passing through the non-cell portion of the transfer roller 222.

It is assumed that whether the excessive charging occurs or not is confirmed by the measurement of the potential of the cell portion in which the excessive charging may be caused. However, the surface electrometer measures only the average potential, so it is difficult to precisely measure the potential of the cell portion in which the excessive charging is caused. Through an intensive examination by the inventors of the present invention, it becomes evident that the presence or absence of the generation of the excessive charging can be confirmed by the measurement of the potential difference between potentials before and after the charging by the charging roller 212 even when the potential of the cell portion is not measured precisely. The white dots generated due to the excessive charging are generated when the potential difference on the photosensitive drum is not generated between potentials before and after the charging by the charging roller 212. Thus, when the non-image forming area is charged, a value of the charging bias applied to the charging roller is changed in advance so that the charged potential becomes lower.

In other words, voltage applied to the charging roller or the transfer roller when a first area passes through the charging portion or the transfer portion, is changed to be different from voltage applied to the charging roller or the transfer roller when a second area passes through the charging portion or the transfer portion, thereby suppressing the generation of the excessive charging. The first area is an area on the photosensitive drum which corresponds to a circumference of the photosensitive drum from the leading edge of the recording medium which is an area on which the white dots are to be generated. In other words, the first area is an area on the photosensitive drum which passes through the transfer portion when the recording medium is not present in the transfer portion, and represents an area on which an electrostatic latent image is to be formed after passing through the charging portion. The second area is an area on the photosensitive drum which passes through the transfer portion when the recording medium is present in the transfer portion, and represents an area on which an electrostatic latent image is to be formed after passing through the charging portion.

Figure 11:
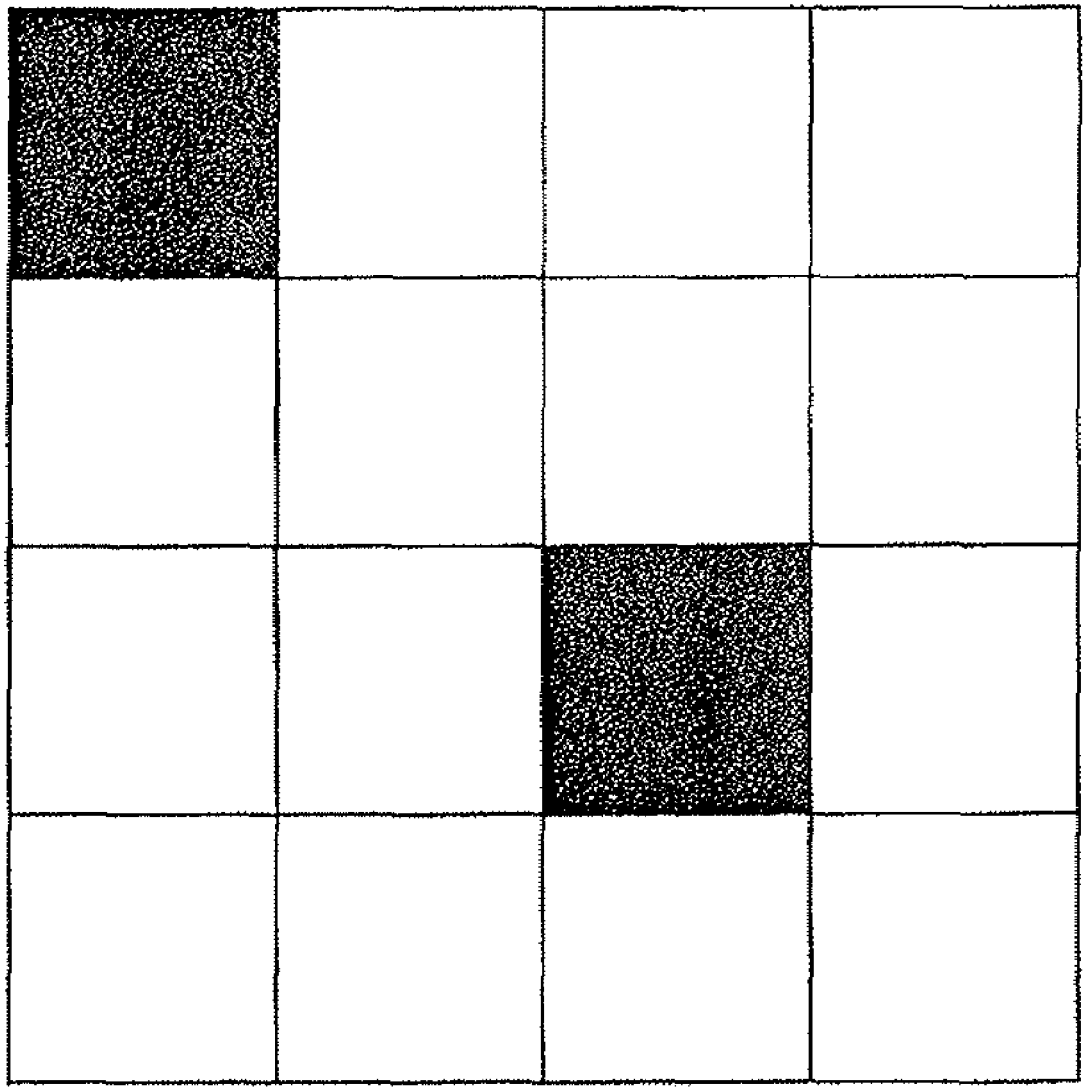
FIG. 11 is an explanatory diagram of a halftone image.

Effects of the first embodiment were observed by conducting the following experiment. The area on the photosensitive drum which is the first area is first pre-charged by the charging roller in advance, and the first area is brought into contact with the transfer roller applied with the transfer bias. After that, voltage of −1000 V is applied to the charging roller to perform re-charging so that the target potential of the photosensitive drum becomes −500 V. Then, a halftone image is formed on the corresponding area and is outputted to observe whether or not the white dots are generated at that time. In this case, the experiment is conducted by changing the voltage value applied to the charging roller when the first area is pre-charged to observe the relationship between the potential difference between the surface potential immediately before the pre-charged area is re-charged and the potential immediately after the pre-charged area is re-charged, and the generation of the white dots. The halftone image obtained by repeatedly forming a dot pattern as shown in FIG. 11 was used. Blacked areas in the dot patterns represent data for forming an image by lighting a laser beam to expose the surface of the drum. Here, one square area surrounded by the dotted lines of FIG. 11 represents one dot, and a size of the dot is about 42 μm×42 μm in a printer with a resolution of 600 dpi×600 dpi.

The measurement of the surface potential was carried out by using the electrometer A and the electrometer B shown in FIG. 6. The surface potential immediately before the re-charging was measured using the electrometer B, and the surface potential immediately after the re-charging was measured using the electrometer A. The applied voltage to the transfer roller was controlled by constant current control in which energization was performed with a current of 3 μA.

TABLE 1

| | | | | | |
|---|---|---|---|---|---|
| Charging Bias with respect to First Area (Pre-charging) | −1000 V | −975 V | −950 V | −925 V | −900 V |
| Potential immediately after Pre-charging | −500 V | −475 V | −450 V | −425 V | −400 V |
| Potential immediately before Re-charging | −450 V | −425 V | −400 V | −375 V | −350 V |
| Charging Bias with respect to Second Area (Re-charging) | −1000 V | −1000 V | −1000 V | −1000 V | −1000 V |
| Potential immediately after Re-charging | −500 V | −500 V | −500 V | −500 V | −500 V |
| Potential Difference between Potential immediately before Re-charging and potential immediately after Re-charging | 50 V | 75 V | 100 V | 125 V | 150 V |
| Generation Level of White Dots | X | Δ | ○ | ○ | ○ |

The result is as shown in Table 1. Here, levels of the generation of the white dots shown in Table 1 are as follows. A level of "x" shown in Table 1 represents a state where an infinite number of white dots with a large size are generated, which has a problem in practical use. A level of "Δ" represents a state where only a few white dots with an extremely small size are generated, which has no problem in practical use. A level of "○" represents a state where no white dot is generated. A target level according to the first embodiment is "Δ" level.

Table 1 will be described below. Since the discharge starting voltage is set to 500 V, a value obtained by subtracting 500 V from voltage applied to the charging roller when the area is charged in advance in terms of an absolute value, becomes the surface potential of the photosensitive drum immediately after the pre-charging. The pre-charged area is moved by the rotation of the photosensitive drum, and is affected by the transfer roller or the like applied with the transfer bias, thereby obtaining the surface potential lowered by 50 V immediately before the re-charging.

As shown in Table 1, it is apparent that the larger the potential difference between the potential immediately before the re-charging and the potential immediately after the re-charging becomes, the more the generation of the white dots can be suppressed. When the charging bias is set to be equal between the time of pre-charging and the time of re-charging (i.e., when the same charging bias is applied to the first area and the second area), the potential difference between the potential immediately before the area is re-charged and the potential immediately after the area was re-charged was small, so a considerable number of white dots were generated, which had a problem in practical use. When the charging bias with respect to the first area is set to be smaller than the charging bias with respect to the second area, it is possible to suppress the generation of the white dots more than at least the case where the same bias is applied to the first area and the second area. Further, when the potential difference between the potential immediately before the re-charging and the potential immediately after the re-charging was 100 V or more, no white dot was generated. The potential immediately after the re-charging was set to −500 V in the structure according to the first embodiment. However, it is apparent that even when the potential is set to a voltage value other then −500 V, the generation of the white dots due to the excessive charging can be suppressed to be extremely low, as long as the potential difference between the potential immediately before the re-charging and the potential immediately after the re-charging is set to be larger.

FIG. 1 shows a sequence chart according to the first embodiment. FIG. 1 represents a timing of a print instruction and a timing of a rotation of the photosensitive drum. In addition, FIG. 1 represents a relationship between the charging bias of the corresponding area (i.e., voltage applied to the charging member), and the surface potential of the photosensitive drum and the transfer bias (i.e., voltage applied to the transfer member) immediately after the charging. Each interval between scale lines indicated by the broken lines parallel to an ordinate axis represents half the circumference of the photosensitive drum. An abscissa axis represents a length of elapsed time. A range 115 represents each area on the photosensitive drum when the recording medium is present in the transfer portion, and a range 110 represents an interval between the recording media when the recording medium is not present in the transfer portion.

In FIG. 1, the first area is defined on the photosensitive drum which passes through the transfer portion when the recording medium is not present between the transfer member and the image bearing member. On the first area, an electrostatic latent image is to be formed. The first area is charged in advance to a potential lower than the target potential required during image formation, thereby making it possible to prevent the white dots due to the excessive charging from being caused.

After the image forming apparatus main body receives a print instruction (101), the photosensitive drum starts to rotate (102).

After that, the charging bias is applied to the charging device. The first area is applied with a charging bias of −950 V which is a potential set to deal with the excessive charging (103), rather than a charging bias of −1000 V at which the target potential (−500 V) of the image forming area is obtained. Then, the surface of the photosensitive drum is uniformly charged to the charged potential of −450 V (104).

Further, the transfer bias is applied to the transfer device (105) at the same time, and the resistance value of the transfer roller is detected by a sequence of detecting the resistance of the transfer roller.

When the image formation is made ready, a feeding operation (not shown) is performed, and the charging bias of −1000 V at which the target potential (of −500 V) of the image forming area is obtained is applied from the area to be judged as the image forming area (106) to thereby charge the surface of the photosensitive drum to the charged potential VD of −500 V (107).

After that, on the surface of the photosensitive drum which has been charged to the charged potential VD, an electrostatic latent image (108) is formed by the exposure device, and the surface potential of the exposed portion on the photosensitive drum becomes the exposure potential VL of −150 V.

The electrostatic latent image formed on the photosensitive drum is subjected to development when the electrostatic latent image reaches the developing roller, and is visualized on the photosensitive drum as a toner image.

When the toner image visualized on the photosensitive drum reaches the transfer roller, the toner image is applied with a predetermined transfer bias (109) so as to be electrostatically transferred onto the recording medium.

Here, in a case where the printing operation is continuously performed, the area corresponding to the interval (110) between the recording media is applied again with the potential set to deal with the excessive charging (111) to obtain the surface potential (112) which is lower than that at the time of image formation.

Then, the surface of the photosensitive drum is applied with the charging bias of −1000 V (113) so as to obtain the charged potential of −500 V at the time of image formation. The charging bias is applied from the area to be judged as the image forming area. In this manner, charging the surface of the photosensitive drum is charged (114).

After completion of the image formation, post-processing is performed, and the subsequent print instruction is waited.

In the above-mentioned sequence, the charging roller is applied with the potential set to deal with the excessive charging over every interval (110) between the recording media so as to obtain the potential lower than the potential of the image forming area, but the sequence is not limited thereto. Any sequence may be adopted as long as the area, which passes through the transfer portion when the recording medium is not present between the transfer roller and the photosensitive drum and on which the latent image is formed after being charged by the charging roller, is applied with the potential set to deal with the excessive charging when the area (i.e., first area) on the charging roller.

While the first embodiment describes the case where means for changing the potential of the photosensitive drum, such as exposure means, is not provided after the transfer and before the charging, the present invention is not limited thereto. After the transfer, even when the exposure means or the like is provided before the charging, the present invention is effective as long as the present invention has a mode in which the exposure means does not operate depending on circumstances such as temperature and humidity. In other words, the potential difference obtained before and after the charging is set to be larger in the mode as in the present invention, thereby making it possible to obtain the effect of suppressing the generation of the white dots. In addition, in the first embodiment, the reason for applying the transfer bias even when the non-image formation is performed is to measure the resistance of the transfer roller. However, the present invention is effective even when the transfer bias is applied for other reasons.

As described in the first embodiment, the area to be judged as the first area is charged to the potential lower than the charged potential of the second area, thereby making it possible to prevent the white dots due to the excessive charging from being caused.

The image forming apparatus described in the first embodiment is only an example, and the present invention is not limited thereto. Numerical values such as the surface potential and the applied voltage are not strictly limited to those shown in the first embodiment.

Second Embodiment

In the first embodiment, in order to make larger the potential difference between the potential immediately before the re-charging and the potential immediately after the re-charging, voltage applied to the charging roller when the first area is charged is set to be lower than voltage applied to the charging roller when the second area is charged, thereby preventing the generation of the white dots due to the excessive charging.

It is an object of a second embodiment to prevent the generation of the white dots due to the excessive charging by setting voltage applied to the charging roller to be equal between the first area and the second area, and by changing a condition of the bias applied to the transfer roller between the first area and the second area.

A structure of the second embodiment is basically similar to that of the first embodiment, so the redundant explanation thereof is omitted.

First, an experiment was conducted to observe a relationship between a value of the transfer bias with respect to the first area and the generation of the white dots.

With respect to the area on the photosensitive drum which corresponds to the first area, a bias of −1000 V was applied to the charging roller to charge the photosensitive drum to the potential of −500 V. The value of the bias applied to the charging roller with respect to the first area was the same as the bias with respect to the second area (i.e., normal image forming area).

The area was pre-charged in advance by the charging roller with voltage of −1000 V and was brought into contact with the transfer roller applied with the transfer bias. After that, voltage of −1000 V was applied to the charging roller to perform re-charging so that the target potential of the photosensitive drum becomes −500 V. Then, a halftone image was formed on the corresponding area and was outputted to be observed as to whether or not the white dots were generated at the time. In this case, the experiment was conducted by changing the current value of the transfer bias applied to the transfer roller to observe the relationship between the potential difference between the surface potential immediately before the pre-charged area is re-charged and the potential difference immediately after the pre-charged area is re-charged, and the generation of the white dots.

The measurement of the surface potential was carried out by using the electrometer A and the electrometer B shown in FIG. 6. The surface potential immediately before the re-charging was measured using the electrometer B, and the surface potential immediately after the re-charging was measured using the electrometer A. The experiment was conducted by changing the transfer bias with respect to the first area in a range from 1 μA to 7 μA in the current value while the transfer bias with respect to the second area is controlled by the constant current control with a current of 3 μA.

TABLE 2

| Set Current Value for Transfer Bias | 1 μA | 2 μA | 3 μA | 4 μA | 5 μA | 6 μA | 7 μA |
|---|---|---|---|---|---|---|---|
| Potential immediately before Re-charging | −472 | −451 | −431 | −411 | −391 | −370 | −350 |
| Potential immediately after Re-charging | −500 V | −500 V | −500 V | −500 V | −500 V | −500 V | −500 V |
| Potential Difference between Potential immediately before Re-charging and potential immediately after Re-charging | 28 | 49 | 69 | 89 | 109 | 130 | 150 |
| Generation Level of White Dots | X | X | X | Δ | ○ | ○ | ○ |

The result is as shown in Table 2. Here, levels of the generation of the white dots shown in Table 2 are similar to those of Table 1 described in the above-mentioned first embodiment.

As shown in Table 2, it is apparent that the larger the potential difference between the potential immediately before the re-charging and the potential immediately after the re-charging becomes, the less the white dots are generated. When the current value of the transfer bias with respect to the first area is set to be equal to the current value of the transfer bias with respect to the second area, the potential difference between the potential immediately before the re-charging and the potential immediately after the re-charging becomes small, leading to the generation of great many white dots, which has been a problem in practical use. When the current value of the transfer bias with respect to the first area is set to be larger than the current value with respect to the first area, it is possible to suppress the generation of the white dots more than at least when the current value of the transfer bias is equally set between the first area and the second area. Further, when the potential difference between the potential immediately before the re-charging and the potential immediately after the re-charging is 100 V or more, no white dot was generated. The potential immediately after the re-charging was set to −500 V in the structure described in the second embodiment. However, it is apparent that even when the potential is set to a voltage value other then −500 V, the generation of the white dots due to the excessive charging can be suppressed to generate only an extremely few white dots, as long as the potential difference between the potential immediately before the re-charging and the potential immediately after the re-charging is set to be larger.

When a current of the transfer bias with respect to the first area is set to be larger, it is possible to lower the potential of the photosensitive drum after passing through the transfer portion. This is because when the current value of the transfer bias is set to be larger, a transfer current starts to flow through the void portion corresponding to the cell portion of a sponge structure, or the potential of the void portion is changed due to a current passing through a wall portion. Thus, it is assumed that it is possible to lower the potential of the area on the photosensitive drum which corresponds to the void portion of the transfer roller in which the potential becomes partially higher as shown in FIGS. 8A and 8B. As a result, a current of the transfer bias is set to be larger, thereby making it possible to suppress the generation of the white dots due to the excessive charging.

Figure 9:
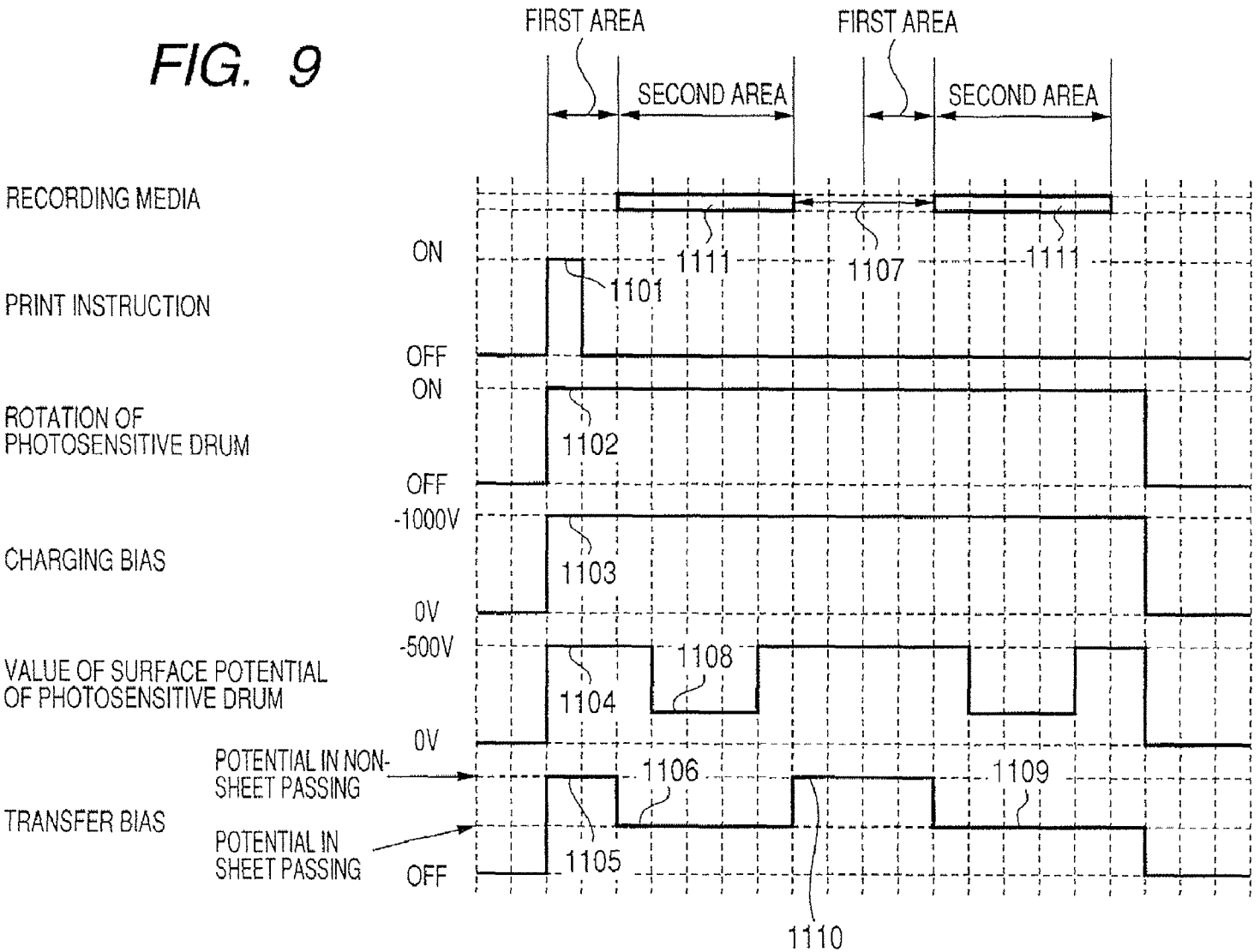
FIG. 9 is a schematic explanatory diagram of a sequence chart according to a second embodiment of the present invention.

FIG. 9 shows a sequence chart according to the second embodiment. FIG. 9 represents a timing of a print instruction and a timing of a rotation of the photosensitive drum. In addition, FIG. 9 represents a relationship between the charging bias of the corresponding area (i.e., voltage applied to the charging member), and the surface potential of the photosensitive drum and the transfer bias (i.e., voltage applied to the transfer member) immediately after the charging. Each interval between scale lines indicated by the broken lines parallel to an ordinate axis represents half the circumference of the photosensitive drum. An abscissa axis represents a length of elapsed time.

A range 1111 represents an area on the photosensitive drum when the recording medium is present in the transfer portion, and a range 1107 represents an interval between the recording media when the recording medium is not present in the transfer portion.

After the image forming apparatus main body receives a print instruction (1101), the photosensitive drum starts to rotate (1102).

After that, a charging bias of −1000 V is applied to the charging device (1103), to thereby uniformly charge the surface of the photosensitive drum to the charged potential VD of −500 V (1104).

Further, the transfer bias is applied to the transfer device at the same time, and the resistance value of the transfer roller is detected by the sequence of detecting the resistance of the transfer roller. With respect to the first area, the transfer bias is set to be the transfer voltage (1105) at which a current of 5 μA is passed.

When the image formation is made ready, a feeding operation (not shown) is performed to start image formation. On the surface of the photosensitive drum which has been charged to the charged potential VD, an electrostatic latent image is formed by the exposure device, and the surface potential of the exposed portion on the photosensitive drum becomes the exposure potential VL of −150 V (1108).

The electrostatic latent image formed on the photosensitive drum is subjected to development when the electrostatic latent image reaches the developing roller, and is visualized on the photosensitive drum as a toner image.

As regards the transfer bias, the voltage (1105), at which a current of 5 μA is passed, is applied to the first area, and the voltage (1106), at which a current of 3 μA is passed, is applied to the second area. The toner image visualized on the photosensitive drum is electrostatically transferred onto the recording medium by the transfer bias.

Here, in a case where the printing operation is continuously performed, the area (1107) corresponding to the interval between the recording media is applied with the voltage (1110) as the transfer bias, at which a current of 5 μA is passed.

Then, the second area in a case where the recording medium is present at the transfer portion is applied with the transfer bias (1109), at which a current of 3 μA is passed, thereby performing a transfer operation.

After completion of the image formation, post-processing is performed, and the subsequent print instruction is waited.

In the above-mentioned sequence, the transfer bias with respect to the first area is set to be larger than the transfer bias with respect to the second area over every interval (1107) between the recording media, but the sequence is not limited thereto. Any sequence may be adopted as long as the transfer bias obtained when the first area passes through the transfer portion is set to be larger than the transfer bias for transferring the toner image onto the recording medium.

While the second embodiment describes the case where means for changing the potential of the photosensitive drum, such as exposure means, is not provided after the transfer and before the charging, the present invention is not limited thereto. After the transfer, even when the exposure means or the like is provided before the charging, the present invention is effective as long as the present invention has a mode in which the exposure means does not operate depending on circumstances such as temperature and humidity. The potential difference obtained before and after the first area is charged is set to be larger in the mode as in the present invention, thereby making it possible to obtain the effect of suppressing the generation of the white dots.

The image forming apparatus described in the second embodiment is only an example, and the present invention is not limited thereto. Numerical values such as the surface potential and the applied voltage are not strictly limited to those shown in the second embodiment.

Third Embodiment

In a third embodiment, the transfer bias together with the charging bias is changed between the first area and the second area, thereby preventing the generation of the white dots due to the excessive charging. Further, it is an object of the third embodiment to suppress each variation width of the charging bias and the transfer bias to be smaller than that according to the second embodiment and the third embodiment.

A structure of the third embodiment is basically similar to that of the first embodiment, so the redundant explanation thereof is omitted.

First, both the charging bias and the transfer bias were changed to observe a relationship among the charging bias, the transfer bias, and the generation of the white dots.

An experiment was conducted as follows. A charging bias with respect to the first area was set to −1000 V, and the target potential of the second area after charging was set to −500 V. The transfer bias with respect to the first area was set to 3 μA.

Under such the condition, the charging bias with respect to the first area was changed from −1000 V to −940 V, and the current value of the transfer bias with respect to the first area was changed from 1 μA to 6 μA, thereby forming a halftone image to be observed as to whether or not the white dots were generated in the area of the halftone image which corresponds to the first area.

The result is as shown in Table 3. Here, levels of the generation of the white dots shown in Table 3 are similar to those of Table 1 described in the above-mentioned first embodiment.

As shown in Table 3, even when both the charging bias and the transfer bias were changed, it was possible to prevent the generation of the white dots due to the excessive charging.

TABLE 3

| | | Transfer Current Value | | | | | |
|---|---|---|---|---|---|---|---|
| | | 1 μA | 2 μA | 3 μA | 4 μA | 5 μA | 6 μA |
| Charging applied voltage value | −1000 | X | X | X | Δ | ○ | ○ |
| | −990 | X | X | Δ | Δ | ○ | ○ |
| | −980 | X | X | Δ | ○ | ○ | ○ |
| | −970 | X | Δ | Δ | ○ | ○ | ○ |
| | −960 | X | X | Δ | ○ | ○ | ○ |
| | −950 | X | X | ○ | ○ | ○ | ○ |
| | −940 | X | Δ | ○ | ○ | ○ | ○ |

Next, Table 4 shows the result obtained from the detailed observation of the generation of the white dots due to the excessive charging when the charging bias with respect to the first area was fixedly set to −980 V, and the current value of the transfer bias was changed.

As shown in Table 4, the charging bias with respect to the first area is set to −980 V, and the current value of the transfer bias is set to 3 μA which is the same value applied with respect to the second area, the level of the generation of the white dots is "Δ" which has no problem in practical use. In this case, when the current value of the transfer bias is raised to cause a current of 4.0 μA to pass, there is obtained the generation level of "○" at which no white dots due to the excessive charging is generated.

Thus, according to the third embodiment, even when the charging bias with respect to the first area was set to −980 V, and the current value of the transfer bias was set to −4.0 μA, no white dot was generated, which means that it is possible to prevent the generation of the white dots due to the excessive charging with a smaller variation width in the amount of change in bias with respect to the first and second areas, as compared with the case of employing a method in which the charging bias and the transfer bias are separately applied as in the first embodiment and the second embodiment (the level of "○" is first obtained when the charging bias is −950 V in the first embodiment, and when the current value of the transfer bias is 5 μA in the second embodiment).

TABLE 4

| | Transfer Current Value | | | |
|---|---|---|---|---|
| | 3.0 μA | 3.5 μA | 4.0 μA | 4.5 μA |
| Surface Potential of Point B | −419 | −410 | −400 | −390 |
| Difference between Potential to be measured and Target Potential | 81 | 90 | 100 | 110 |
| Generation Level of White Dots | Δ | Δ | ○ | ○ |

Figure 10:
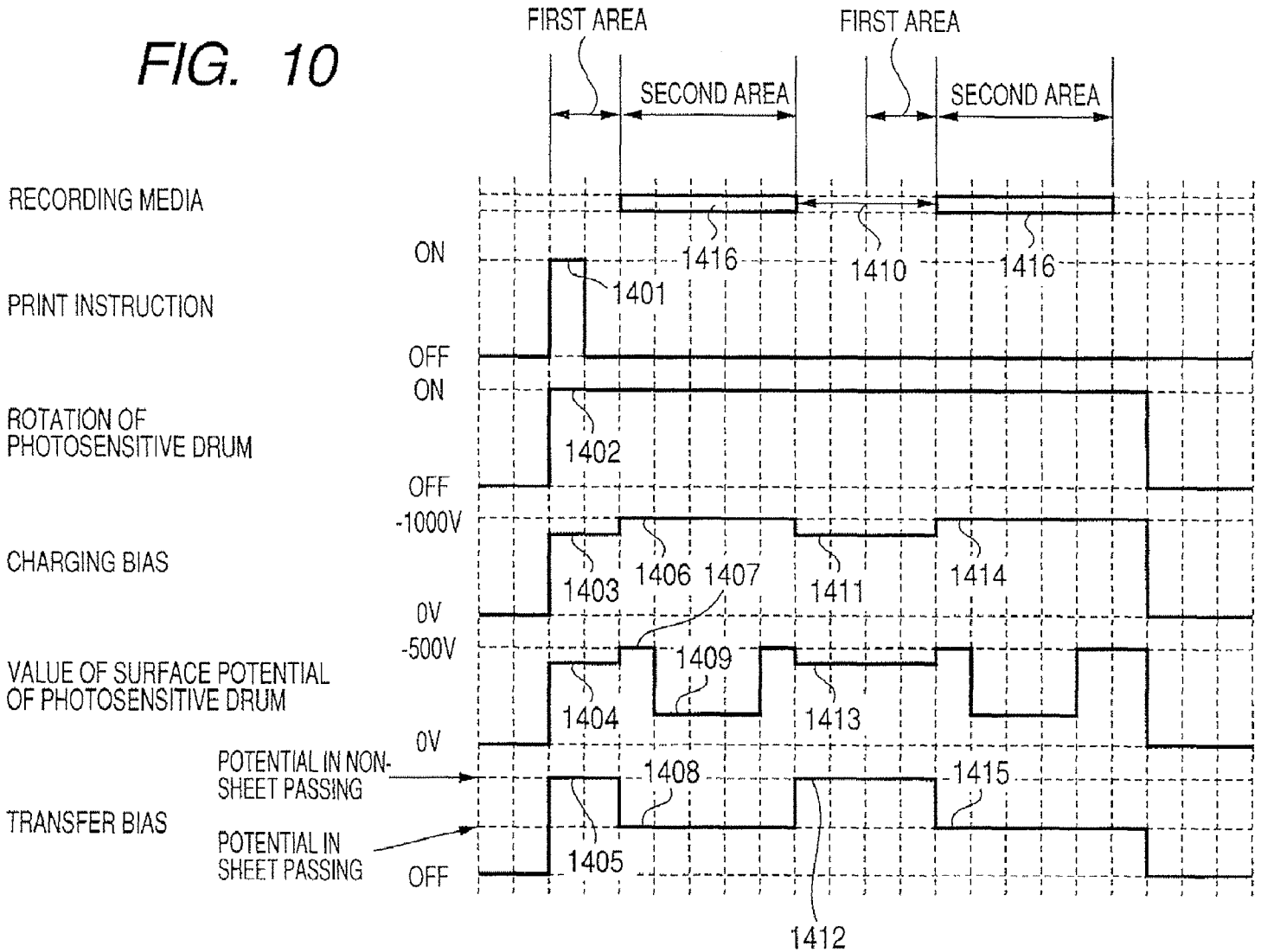
FIG. 10 is a schematic explanatory diagram of a sequence chart according to a third embodiment of the present invention.

FIG. 10 shows a sequence chart according to the third embodiment. FIG. 10 represents a timing of a print instruction and a timing of a rotation of the photosensitive drum. In addition, FIG. 10 represents a relationship between the charging bias of the corresponding area (i.e., voltage applied to the charging member), and the surface potential of the photosensitive drum and the transfer bias (i.e., voltage applied to the transfer member) immediately after the charging. Each interval between scale lines indicated by the broken lines parallel to an ordinate axis represents half the circumference of the photosensitive drum. An abscissa axis represents a length of elapsed time. A range 1416 represents each area on the photosensitive drum when the recording medium is present in the transfer portion, and a range 1410 represents an interval between the recording media when the recording medium is not present in the transfer portion.

In FIG. 10, after the image forming apparatus main body receives a print instruction (1401), the photosensitive drum starts to rotate (1402).

After that, the charging bias is applied to the charging device. The charging device is applied with the charging bias of −980 V which is the potential set to deal with the excessive charging on the first area, rather than the charging bias of −1000 V at which the target potential (−500 V) on the image forming area is obtained (1403). Then, the surface of the photosensitive drum is uniformly charged to the charged potential of −480 V (1404).

Further, the transfer bias is applied to the transfer roller, and the resistance value of the transfer roller is detected by the sequence of detecting the resistance of the transfer roller. Thus, the transfer roller is applied with the transfer bias at which a current of 4 μA is caused to flow through the first area (1405).

When the image formation is made ready, a feeding operation (not shown) is performed, and the charging bias of −1000 V at which the target potential of −500 V is obtained is applied from the area judged as the second area (1406) to thereby charge the surface of the photosensitive drum to the charged potential VD of −500 V (1407). Here, the current value of the transfer bias is also set to 3 μA, which is the current value at the time of image formation (1408).

After that, on the surface of the photosensitive drum which has been charged to the charged potential VD, an electrostatic latent image (1409) is formed by the exposure device, and the surface potential of the exposed portion on the photosensitive drum becomes the exposure potential VL of −150 V.

The electrostatic latent image formed on the photosensitive drum is subjected to development when the electrostatic latent image reaches the developing roller, and is visualized on the photosensitive drum as a toner image.

When the toner image visualized on the photosensitive drum reaches the transfer roller, the toner image is electrostatically transferred onto the recording medium through the application of a predetermined transfer bias (1409).

Here, in a case where the printing operation is continuously performed, the area (1410) corresponding to the interval between the recording media is applied again with the potential set to deal with the excessive charging (1410) to obtain the surface potential (1411) which is lower than that of the second area. In addition, the current value of the transfer bias is set to 4 μA (1412).

Then, the charging bias of −1000 V is applied (1413) again from the area judged to be the second area so as to obtain the target potential of the photosensitive drum of −500 V, thereby setting the transfer bias to cause a current of 3 μA to pass.

After completion of the image formation, post-processing is performed, and the subsequent print instruction is waited.

In the above-mentioned sequence, the potential set to deal with the excessive charging is applied to the charging roller so that the potential becomes lower than that on the image forming area, and the transfer bias is set to 4 μA over each interval (1410) between the recording media, but the sequence is not limited thereto. Any sequence may be adopted as long as the charging bias and the transfer bias are switched in a case of charging the area (i.e., first area) which passes through the transfer portion when the recording medium is not present between the transfer roller and the photosensitive drum, and on which the latent image is formed after being charged by the charging roller.

As described in the third embodiment, the charging bias and the transfer bias are changed between the first area and the second area, thereby making it possible to prevent the generation of the white dots due to the excessive charging.

The image forming apparatus described in the third embodiment is only an example, and the present invention is not limited thereto. Numerical values such as the surface potential and the applied voltage are not strictly limited to those shown in the second embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-284997, filed Oct. 19, 2006, which is hereby incorporated by reference herein in its entirety.

What is claimed is:

1. An image forming apparatus comprising:

an image bearing member, which bears a developer image;

a charging member applied with a DC voltage excluding an AC voltage component, for charging the image bearing member in a charging portion;

a developing device, which reversal-develops an electrostatic latent image formed on the image bearing member with a developer to form the developer image;

a transfer member, which transfers the developer image onto a recording material in a transfer portion; and control means for controlling voltage applied to the charging member and voltage applied to the transfer member, wherein charge is not eliminated from the image bearing member between the transfer portion and the charging portion, a surface of the transfer member comprises a foam, and the transfer member is brought into contact with the image bearing member to perform transfer by passing the recording material between the transfer member and the image bearing member, an area on the image bearing member which passes through the transfer portion when the recording material is not present between the transfer member and the image bearing member, and on which an electrostatic latent image is to be formed, is set as a first area, an area on the image bearing member which passes through the transfer portion when the recording material is present between the transfer member and the image bearing member, and on which an electrostatic latent image is to be formed, is set as a second area, when the first area passes through the transfer portion, voltage is applied to the transfer member, and the control means controls to change at least one of voltage applied to the charging member and voltage applied to the transfer member between the first area and the second area to set a potential difference between a potential of the second area before passing through the charging portion and a potential of the second area after passing through the charging portion to 100 V or more.

2. An image forming apparatus comprising:

an image bearing member, which bears a developer image;

a charging member applied with a DC voltage excluding an AC voltage component, for charging the image bearing member in a charging portion;

a developing device, which reversal-develops an electrostatic latent image formed on the image bearing member with a developer to form the developer image;

a transfer member, which transfers the developer image onto a recording material in a transfer portion; and control means for controlling voltage applied to the charging member and voltage applied to the transfer member, wherein charge is not eliminated from the image bearing member between the transfer portion and the charging portion, a surface of the transfer member comprises a foam, and the transfer member is brought into contact with the image bearing member to perform transfer by passing the recording material between the transfer member and the image bearing member, an area on the image bearing member which passes through the transfer portion when the recording material is not present between the transfer member and the image bearing member, and on which an electrostatic latent image is to be formed, is set as a first area, an area on the image bearing member which passes through the transfer portion when the recording material is present between the transfer member and the image bearing member, and on which an electrostatic latent image is to be formed, is set as a second area, when the first area passes through the transfer portion, voltage is applied to the transfer member, and the control means controls voltage applied to the transfer member to set a value of an electric current passing from the transfer member to the image bearing member when the first area passes through the transfer portion, to be larger than a value of an electric current passing from the transfer member to the image bearing member when the second area passes through the transfer portion.

3. An image forming apparatus comprising:

an image bearing member, which bears a developer image;

a charging member applied with a DC voltage excluding an AC voltage component, for charging the image bearing member in a charging portion;

a developing device, which reversal-develops an electrostatic latent image formed on the image bearing member with a developer to form the developer image;

a transfer member, which transfers the developer image onto a recording material in a transfer portion; and control means for controlling voltage applied to the charging member and voltage applied to the transfer member, wherein charge is not eliminated from the image bearing member between the transfer portion and the charging portion, a surface of the transfer member comprises a foam, and the transfer member is brought into contact with the image bearing member to perform transfer by passing the recording material between the transfer member and the image bearing member, an area on the image bearing member which passes through the transfer portion when the recording material is not present between the transfer member and the image bearing member, and on which an electrostatic latent image is to be formed, is set as a first area, an area on the image bearing member which passes through the transfer portion when the recording material is present between the transfer member and the image bearing member, and on which an electrostatic latent image is to be formed, is set as a second area, when the first area passes through the transfer portion, voltage is applied to the transfer member, and the control means controls voltage applied to the charging member when the first area passes through the charging portion to be set smaller than voltage applied to the charging member when the second area passes through the charging portion.

* * * * *